US007819380B2

(12) United States Patent
Sugiyama et al.

(10) Patent No.: US 7,819,380 B2
(45) Date of Patent: Oct. 26, 2010

(54) SOLENOID APPARATUS AND INJECTION VALVE USING THE SAME

(75) Inventors: Koichi Sugiyama, Nagoya (JP); Shinsuke Yamamoto, Kariya (JP); Takayuki Hokao, Anjo (JP)

(73) Assignee: Denso Corporation, Kariya (JP)

( * ) Notice: Subject to any disclaimer, the term of this patent is extended or adjusted under 35 U.S.C. 154(b) by 1104 days.

(21) Appl. No.: 11/349,283

(22) Filed: Feb. 8, 2006

(65) Prior Publication Data

US 2006/0175911 A1 Aug. 10, 2006

(30) Foreign Application Priority Data

Feb. 10, 2005 (JP) ..... 2005-034592
Dec. 20, 2005 (JP) ..... 2005-366148

(51) Int. Cl.
*F16K 31/06* (2006.01)

(52) U.S. Cl. ..... 251/129.21; 251/129.15; 335/261; 335/281

(58) Field of Classification Search ..... 251/129.21, 251/129.15; 335/225, 261, 262, 279, 281, 335/291; 314/14, 17, 23
See application file for complete search history.

(56) References Cited

U.S. PATENT DOCUMENTS 4,604,600 A * 8/1986 Clark ..... 335/261
5,732,888 A 3/1998 Maier et al.
5,918,818 A * 7/1999 Takeda ..... 239/585.1
6,405,947 B2 * 6/2002 Fochtman ..... 239/585.4
7,051,960 B2 * 5/2006 Oguma ..... 239/585.1
7,530,506 B2 5/2009 Kato et al.

FOREIGN PATENT DOCUMENTS

JP 2003-106236 4/2003
JP 2003-113753 4/2003
JP 2004-270490 9/2004

OTHER PUBLICATIONS

Japanese Office Action dated Oct. 8, 2009, issued in corresponding Japanese Application No. 2005-366148, with English translation.

* cited by examiner

*Primary Examiner*—John Rivell
*Assistant Examiner*—Jeremy S Baskin
(74) *Attorney, Agent, or Firm*—Nixon & Vanderhye

(57) ABSTRACT

A solenoid apparatus includes a fixed core, a coil, and a movable core. The coil generates magnetic attractive force when the coil is supplied with electricity. The movable core is attracted to the fixed core by the magnetic attractive force generated between the fixed core and the movable core when the coil is supplied with electricity. The fixed core has a fixed axial end on a side of the movable core. The movable core has a movable axial end on a side of the fixed core. At least one of the fixed axial end and the movable axial end has at least one recession. The at least one of the fixed axial end and the movable axial end, which has the at least one recession, has an outer circumferential periphery and an inner circumferential periphery. The outer circumferential periphery radially communicates with the inner circumferential periphery through the at least one recession.

16 Claims, 9 Drawing Sheets

SOLENOID APPARATUS AND INJECTION VALVE USING THE SAME

CROSS REFERENCE TO RELATED APPLICATIONS

This application is based on and incorporates herein by reference Japanese Patent Applications No. 2005-34592 filed on Feb. 10, 2005 and No. 2005-366148 filed on Dec. 20, 2005.

FIELD OF THE INVENTION

The present invention relates to a solenoid apparatus and an injection valve using the solenoid apparatus.

BACKGROUND OF THE INVENTION

Conventionally, a solenoid apparatus is used in a valve device such as a fuel injection valve and a pressure control valve. The solenoid apparatus includes a coil, which is supplied with electricity to operate a movable member. The solenoid apparatus has a fixed core and a movable core. The movable core is attracted to the fixed core by magnetic force generated therebetween when the coil is supplied with electricity. The movable member of the solenoid apparatus is operated together with the movable core.

The fixed core and the movable core repeat colliding against each other by repeating supplying electricity to the coil and repeating terminating the supplying electricity to the coil. According to U.S. Pat No. 5,732,888 (JP-A-8-506877), the movable core has a stepwise portion in the end thereof, in which the fixed core and the movable core oppose to each other, for securing a predetermined contact area therebetween. The stepwise portion is substantially in one of a cylindrical shape and a substantially tapered shape, for example. The fixed core and the movable core respectively have the ends thereof, in which the fixed core and the movable core oppose to each other. The ends of the fixed core and the movable core respectively have a hardened layer for reducing abrasion and deformation due to collision against each other.

In this structure of the solenoid apparatus, the movable core has the stepwise portion continuously extending in the circumferential periphery throughout in the circumferential direction thereof. In this structure, fluid intrudes into the gap between the fixed core and the movable core when the fixed core makes contact with the movable core. The fluid intruding between the fixed core and the movable core may cause squeeze force due to surface tension of the fluid, when the fixed core is spaced from the movable core. When the squeeze force arises, the squeeze force disturbs spacing motion of the fixed core from the movable core, consequently, response of the movable core may be degraded when the movable core is spaced from the fixed core.

As the fixed core repeats colliding against the movable core, the fixed core may fit to the movable core due to abrasion caused by colliding against each other. This fitting arises due to deformation caused in the end of the fixed core and the end of the movable core opposing to each other. As the end of the fixed core fits to the end of the movable core, the contact surface therebetween increases. Therefore, as the time elapses, the squeeze force arising between the fixed core and the movable core increases. As a result, response of the movable core when the movable core is spaced from the fixed core may change as the time elapses.

Furthermore, the hardening layer is formed in the ends of the fixed core and the movable core by hard chrome plating, for example. This plating process takes long, consequently, manufacturing process may be lengthened.

In addition, the end of the fixed core may not make contact with the end of the movable core via the entire surfaces therebetween in an initial condition thereof because of variation in manufacturing accuracy of the colliding portion and non-uniformity of the hardened layer. Accordingly, even when a hardened layer such as hardened chrome plated layer is formed, the end of the fixed core may not make contact with the end of the movable core via the entire surfaces therebetween in the initial condition thereof immediately after manufacturing the solenoid apparatus. However, as the fixed core repeats colliding against the movable core, the end of the fixed core gradually fits to the end of the movable core, so that the contact area therebetween may gradually increase. As a result, as time elapses, the response of the movable core may be degraded.

SUMMARY OF THE INVENTION

In view of the foregoing and other problems, it is an object of the present invention to produce a solenoid apparatus, in which a response of movement is restricted from varying as time elapses. It is another object of the present invention to produce an injection valve, in which an amount of injection is restricted from varying as time elapses.

According to one aspect of the present invention, a solenoid apparatus includes a fixed core, a coil, and a movable core. The coil generates magnetic attractive force when the coil is supplied with electricity. The movable core is attracted to the fixed core by the magnetic attractive force generated between the fixed core and the movable core when the coil is supplied with electricity. The fixed core has a fixed axial end on a side of the movable core with respect to an axial direction of the fixed core. The movable core has a movable axial end on a side of the fixed core with respect to an axial direction of the movable core. At least one of the fixed axial end and the movable axial end has at least one recession.

The at least one of the fixed axial end and the movable axial end, which has the at least one recession, has an outer circumferential periphery and an inner circumferential periphery. The outer circumferential periphery communicates with the inner circumferential periphery through the at least one recession with respect to a radial direction of the at least one of the fixed axial end and the movable axial end, which has the at least one recession.

Alternatively, the at least one recession is formed partially with respect to a circumferential direction of the at least one of the fixed axial end and the movable axial end, which has the at least one recession. The at least one of the fixed axial end and the movable axial end, which has the at least one recession, has an outer circumferential periphery. The at least one recession extends from the outer circumferential periphery to an inner side with respect to a radial direction of the at least one of the fixed axial end and the movable axial end, which has the at least one recession.

In the above structure, the fixed core may be spaced from the movable core, so that the squeeze force can be restricted from arising around the recession, thereby enhancing a spacing motion of the movable core from the fixed core. Thus, this spacing motion can be restricted from being disturbed due to the squeeze force.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
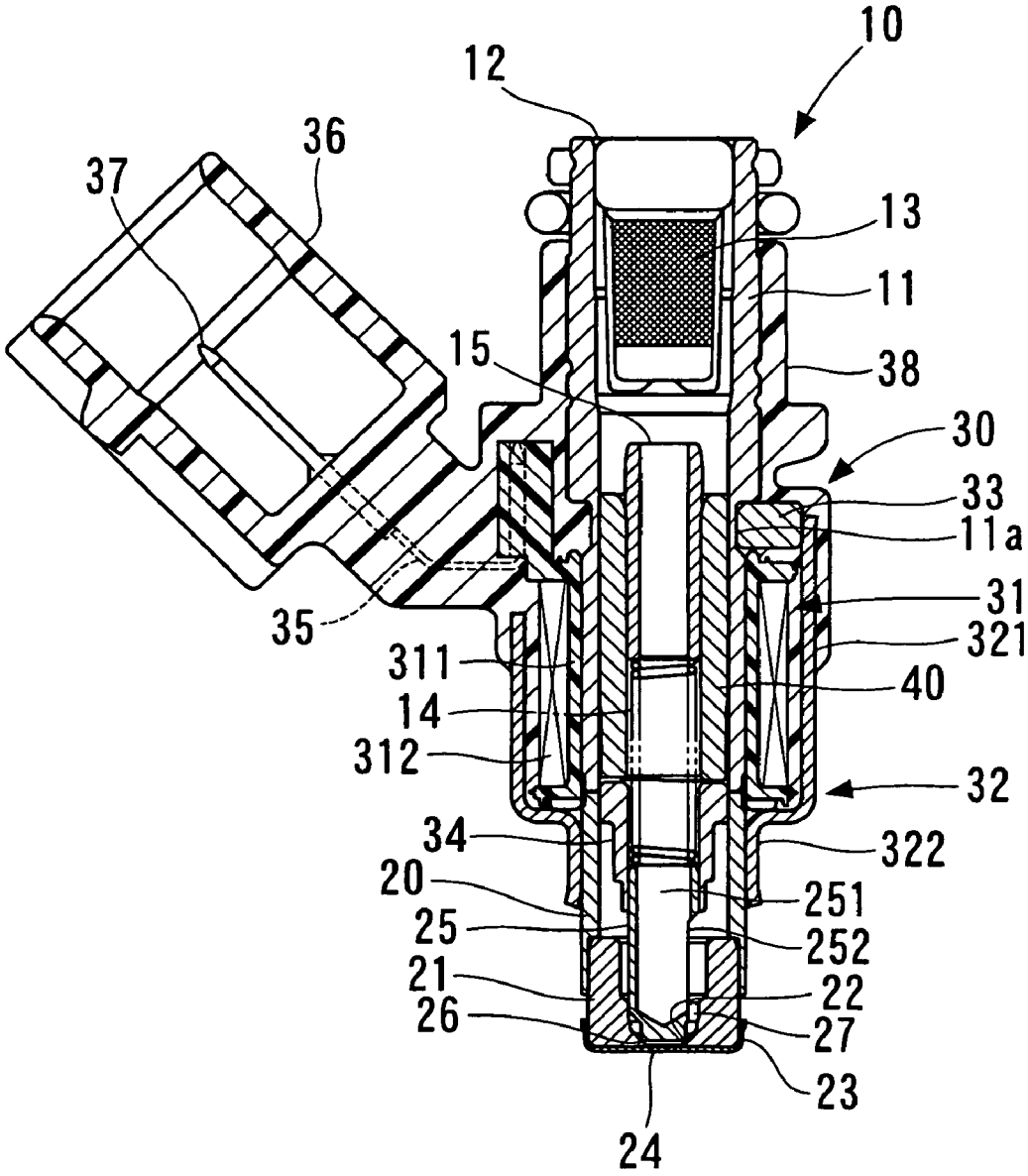
FIG. 1 is a partially cross sectional side view showing an injector, according to a first embodiment of the present invention.

As shown in FIG. 1, a fuel injection valve (injector) 10 injects fuel into a gasoline engine using a solenoid apparatus, for example. This injector 10 may be applied to a direct injection gasoline engine, in which the injector 10 directly injects gasoline into a combustion chamber of the gasoline engine. Alternatively, the injector 10 may be applied to a diesel engine.

The injector 10 has an accommodating pipe 11, which is formed to be in a substantially cylindrical shape having a thin wall. The accommodating pipe 11 has an axial end, on which a fuel inlet 12 is formed. Fuel is supplied from a fuel pump (not shown) into the fuel inlet 12, and the fuel flows into the accommodating pipe 11 through the fuel inlet 12 and a fuel filter 13. The fuel filter 13 is provided to the end of the accommodating pipe 11 for removing foreign matters contained in fuel. In this embodiment, the accommodating pipe 11 is formed of a nonmagnetic material having the thin wall.

The accommodating pipe 11 has the other end on the opposite side of the fuel inlet 12. The other end of the accommodating pipe 11 is provided with a nozzle holder 20, which is formed of a magnetic material to be in a substantially cylindrical shape. The nozzle holder 20 is substantially coaxial with the accommodating pipe 11. The accommodating pipe 11 is integrally connected with the nozzle holder 20 using laser wilding, for example. The nozzle holder 20 accommodates a valve body 21 therein. The accommodating pipe 11 and the nozzle holder 20 may be formed integrally with each other. Alternatively, the accommodating pipe 11 and the nozzle holder 20 may be formed individually from each other.

The valve body 21 is formed to be in a substantially cylindrical shape. The valve body 21 is fixed to the end of the nozzle holder 20 on the opposite side of the accommodating pipe 11 with respect to the nozzle holder 20. The valve body 21 has a substantially conical inner wall that decreases in inner diameter toward the tip end thereof. The conical inner wall of the valve body 21 accommodates a valve seat 22. The valve body 21 has an end, which is on the opposite side of the accommodating pipe 11, connecting with a nozzle plate 23. Specifically, the nozzle plate 23 is fixed to the valve body 21 such that the nozzle plate 23 covers the end of the valve body 21 on the opposite side of the accommodating pipe 11. The nozzle plate 23 has a nozzle hole 24 that penetrates the nozzle plate 23 in a direction of the thickness of the nozzle plate 23. The end surface of the nozzle plate 23 on the side of the valve body 21 communicates with the end surface of the nozzle plate 23 on the opposite side of the valve body 21 through the nozzle hole 24.

The nozzle holder 20 and the valve body 21 accommodate a needle 25 therein such that the needle 25 is capable of moving back and forth in the axial direction thereof. The needle 25 is substantially coaxial with the nozzle holder 20. The needle 25 serves as a valve member. The needle 25 is in a substantially cylindrical shape having a seal portion 26 in the vicinity of the end of the needle 25 on the side of the nozzle plate 23. The seal portion 26 of the needle 25 is adapted to contact with the valve seat 22 formed in the valve body 21. The needle 25 and the valve body 21 form a fuel passage 27 therebetween such that fuel flows through the fuel passage 27. The needle 25 has the inner circumferential periphery, which forms a fuel passage 251, through which fuel flows. The needle 25 has the sidewall, which forms an opening 252. Fuel passing through the fuel passage 251 flows into the fuel passage 27 through the opening 252.

The injector 10 has a driving portion 30 that operates the needle 25. The driving unit 30 serves as a solenoid apparatus. The driving unit 30 includes a coil 31, a fixed core 40, a first magnetic member 32, a second magnetic member 33, and a movable core 34.

The driving unit 30 is constructed of the nozzle holder 20 in addition to the coil 31, the fixed core 40, the first magnetic member 32, the second magnetic member 33, and the movable core 34. The coil 31 includes a spool 311 and a winding 312. The spool 311 is formed of resin to be in a substantially cylindrical shape. The winding 312 is wound around the outer circumferential periphery of the spool 311. The winding 312 of the coil 31 electrically connects with a terminal 37 of a connector 36 via a wiring member 35. The accommodating pipe 11 is inserted into the inner circumferential periphery of the spool 311, so that the coil 31 is arranged on the side of the outer circumferential periphery of the accommodating pipe 11.

The fixed core 40 is arranged on the side of the inner circumferential periphery of the coil 31 via the accommodating pipe 11. The fixed core 40 is formed of a magnetic material such as iron to be in a substantially cylindrical shape. The coil 31, first magnetic member 32, and the second magnetic member 33 are covered with a resin mold 38 on the side of the outer circumferential peripheries thereof. The resin mold 38 is formed integrally with the connector 36.

The first magnetic member 32 is formed of a magnetic material. The first magnetic member 32 surrounds the end of the coil 31 and outer circumferential periphery of the coil 31 on the side of the nozzle hole 24 with respect to the coil 31. The first magnetic member 32 has a large diameter portion 321 and a small diameter portion 322. The small diameter portion 322 covers the outer circumferential periphery of the nozzle holder 20, so that the first magnetic member 32 magnetically connects with the nozzle holder 20. The large diameter portion 321 accommodates the coil 321 therein. The first magnetic member 32 has the end, which is on the opposite side of the small diameter portion 322, connecting with the second magnetic member 33. The second magnetic member 33 is formed of a magnetic material. The second magnetic member 33 is accommodated in the inner circumferential periphery of the large diameter portion 321 of the first magnetic member 32. The second magnetic member 33 has the outer circumferential periphery that connects with the first magnetic member 32. The second magnetic member 33 has the inner circumferential periphery that connects with the accommodating pipe 11.

The accommodating pipe 11 has a thin wall portion 11*a*, which has a small thickness. The thin wall portion 11*a* makes contact with the inner periphery of the second magnetic member 33. The second magnetic member 33 radially opposes to the fixed core 40 via the thin wall portion 11*a* of the accommodating pipe 11. When electricity is supplied to the coil 31, the coil 31 generates magnetic field, so that magnetic flux is generated between the second magnetic member 33 and the fixed core 40. In this condition, the second magnetic member 33 and the fixed core 40 radially interpose the thin wall portion 11*a* therebetween, so that the magnetic flux generated between the second magnetic member 33 and the fixed core 40 easily passes through the thin wall portion 11*a* of the accommodating pipe 11. Thus, even when the accommodating pipe 11 is formed of a nonmagnetic material, a sufficient amount of magnetic flux can be generated between the second magnetic member 33 and the fixed core 40.

The movable core 34 is arranged in the inner circumferential periphery of the nozzle holder 20 such that the movable core 34 is axially movable back and forth. The movable core 34 has the end (movable axial end), which is on the opposite side of the nozzle hole 24, opposing to the fixed core 40. The movable core 34 has the outer wall that is slidable with respect to the inner wall of the nozzle holder 20. The movable core 34 is formed of a magnetic material such as iron to be in a substantially cylindrical shape. The needle 25 has the end, which is on the opposite side of the seal portion 26, fixed to the inner periphery of the movable core 34. The needle 25 is secured to the movable core 34 by press insertion or welding, for example. Thus, the needle 25 is axially movable back and forth integrally with the movable core 34. In this structure, the end of the needle 25 on the opposite side of the seal portion 26 is secured to the inner periphery of the movable core 34, and this end of the needle 25 connects with the spring 14. The spring 14 serves as a biasing member. The spring 14 has one end, which connects with the needle 25. The spring 14 has the other end, which connects with an adjusting pipe 15. The spring 14 has resiliency, thereby axially extending, so that the spring 14 presses the needle 25, which is integral with the movable core 34, in the direction, in which the needle 25 seats onto the valve seat 22. The adjusting pipe 15 is press-inserted into the fixed core 40, for example. Basing force of the spring 14 can be adjusted by adjusting the degree, for which the adjusting pipe 15 is press-inserted into the fixed core 40. When electricity is not supplied to the coil 31, the movable core 34 and the needle 25, which are integrated with each other, are pressed to the valve seat 22, so that the seal portion 26 seats onto the valve seat 22.

Next, the end of the fixed core 40 on the side of the movable core 34 is described.

Figure 2A:
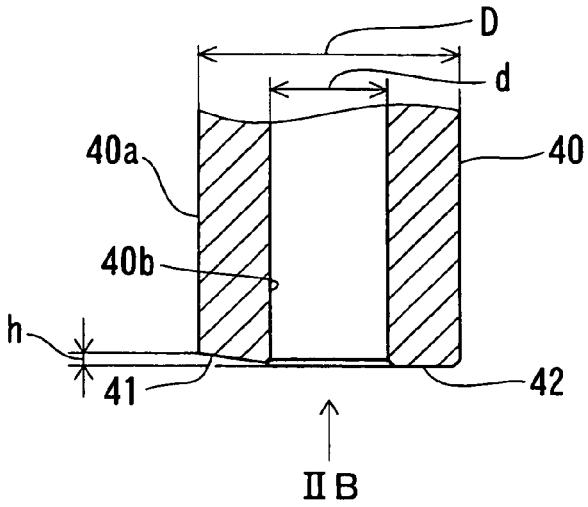
FIG. 2A is a cross sectional side view showing a fixed core of the injector.
Figure 2B:
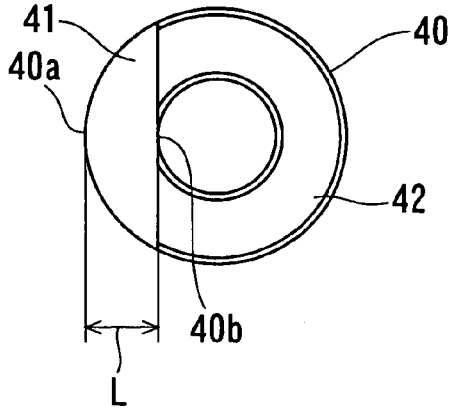
FIG. 2B is a view when being viewed from the arrow IIB in FIG. 2A, according to the first embodiment.

The fixed core 40 is formed of a magnetic material to be in a substantially cylindrical shape. As shown in FIGS. 2A, 2B, the fixed core 40 has a notch (recession) 41 on the side of the movable core 34 on the lower side in FIG. 2A. The notch 41 is formed in the end (fixed axial end) of the fixed core 40 on the side of the movable core 34 partially with respect to the circumferential direction of the fixed core 40. In this structure, the end of the fixed core 40 on the side of the movable core 34 has the notch 41 and the land 42. Specifically, the notch 41 is formed partially with respect to the circumferential direction of the end of the fixed core 40, so that the land 42 is formed to be discontinuous with respect to the circumferential direction of the fixed core 40 (FIG. 2B). The notch 41 is formed from an outer circumferential periphery 40*a* of the substantially cylindrical fixed core 40 to an inner circumferential periphery 40*b* of the fixed core 40. In this structure, the notch 41 communicates the outer circumferential periphery 40*a* of the fixed core 40 with the inner circumferential periphery 40*b*. Specifically, the notch 41 communicates the outer circumferential periphery 40*a* of the fixed core 40 with the inner circumferential periphery 40*b* when the fixed core 40 makes contact with the movable core 34. The notch 41 is formed to be in a substantially tapered shape such that the notch 41 protrudes to the side of the movable core 34. The notch 41 protrudes from the outer circumferential periphery 40*a* toward the inner circumferential periphery 40*b*. In this embodiment, the notch 41 is formed to be in a substantially bow shape. Specifically, the notch 41 is constructed of a substantially arch shaped portion, which extends along the outer circumferential periphery 40*a* of the fixed core 40, and a substantially linear portion connecting both the ends of this arch shaped portion. The land 42 excluding the notch 41 is formed to be in a substantially arch shape.

The substantially cylindrical fixed core 40 has the outer diameter D, and has the inner diameter d. The notch 41 has the radial length L with respect to the radial direction of the fixed core 40. The dimension of the fixed core 40 preferably satisfies the following relationship: $(D-d)/2 \leqq L \leqq (3D-d)/4$.

When the radial length L of the notch 41 becomes less than $(D-d)/2$, the notch 41 cannot communicate the outer circumferential periphery 40*a* of the fixed core 40 with the inner circumferential periphery 40*b*. As a result, the notch 41 cannot have a proper function to communicate the outer periphery with the inner periphery of the fixed core 40.

When the radial length L of the notch 41 becomes greater than (3D−d)/4, the land 42, which remains in the end of the fixed core 40, becomes excessively small. As a result, when the movable core 34 makes contact with the fixed core 40, the movable core 34 is apt to be slanted. Accordingly, the operations of the movable core 34 and the needle 25 may become unstable, consequently, accuracy of the injection amount of fuel may be degraded. By contrast, when the radial length L of the notch 41 is equal to or less than (3D−d)/4, the land 42 of the fixed core 40 is capable of making contact entirely with the end surface of the movable core 43 via whole area thereof from the initial condition where the fixed core 40 collides against the movable core 43.

The notch 41 has the height h in the axial direction of the fixed core 40 on the side of the outer circumferential periphery 40*a* of the fixed core 40. The height h of the notch 41 preferably satisfies the following relationship: 5 μm≦h≦2.0 mm. When the height h of the notch 41 becomes less than 5 μm, the squeeze force of the fuel may exert a large influence on the response of the movable core 34. As a result, the notch 41 may not become an initial point, from which the end surface of the fixed core 40 starts spacing from the end surface of the movable core 34. By contrast, when the height h of the notch 41 becomes greater than 2.0 mm, the notch 41 and the land 42 form a large step therebetween. As a result, the movable core 34 becomes apt to be slanted on the end surface of the fixed core 40.

In the above structure, the notch 41 is formed in the end of the fixed core 40 on the side of the movable core 34. Therefore, the notch 41 forms a sufficient space between the movable core 34 and the fixed core 40 when the movable core 34 makes contact with the fixed core 40. In this structure, the fixed core 40 is spaced from the movable core 34, so that the squeeze force is restricted from arising around the notch 41, thereby enhancing spacing motion of the movable core 34 from the fixed core 40. Thus, this spacing motion can be restricted from being disturbed due to the squeeze force, so that the movable core 34 can be readily spaced from the fixed core 40 such that the movable core 34 is detached from the notch 41 as the initial point of the spacing motion.

Furthermore, the end of the fixed core 40 on the side of the movable core 34 has the notch 41 and the land 42. Therefore, the magnetic attractive force, which is generated between the fixed core 40 and the movable core 34 when the coil 31 is supplied with electricity, becomes unbalance between the side of the notch 41 and the side of the land 42. Specifically, this magnetic force becomes large on the side of the land 42, which is in the vicinity of the movable core 34, and becomes small on the side of the notch 41, which is distant from the movable core 34. Therefore, the movable core 34 is attracted to the side of the land 42 of the fixed core 40 by the magnetic attractive force greater than the magnetic force on the side of the notch 41. Thus, the movable core 34 is attracted regularly toward the fixed core 40 on the side of the land 42, so that the movable core 34 is capable of colliding against the fixed core 40 regularly in a constant position. therefore, the contact area between the fixed core 40 and the movable core 34 can be restricted from varying, even when the movable core 34 repeatedly collides against the fixed core 40, as the operation of the injector 10 is repeated.

Next, the operation of the injector 10 is described.

When electricity supply to the coil 31 is stopped, the fixed core 40 and the movable core 34 terminate generating the magnetic attractive force therebetween, so that the movable core 34 moves to the opposite side of the fixed core 40 by being biased from the spring 14. In this condition, the needle 25, which is integrated with the movable core 34, moves to the opposite side of the fixed core 40. Thus, when the electricity supply to the coil 31 is terminated, the seal portion 26 of the needle 25 seats onto the valve seat 22, so that fuel is restricted from flowing out of the jet nozzle 24.

When the coil 31 is supplied with electricity, the coil 31 generates magnetic field that forms a magnetic circuit among the first magnetic member 32, the nozzle holder 20, the movable core 34, the fixed core 40, and the second magnetic member 33, so that magnetic flux passes though this magnetic circuit. In this condition, the fixed core 40 and the movable core 34, which are spaced from each other, generate magnetic force therebetween, while the coil 31 is supplied with electricity. When this magnetic force generated between the fixed core 40 and the movable core 34 becomes greater than the biasing force of the spring 14, the movable core 34 moves together with the needle 25 toward the fixed core 40. Thus, the seal portion 26 of the needle 25 lifts from the valve seat 22.

Fuel flows into the injector 10 through the fuel inlet 12. The fuel flows from the fuel inlet 12 into the fuel passage 27 after passing through the fuel filter 13, the inside of the accommodating pipe 11, the inside of the adjusting pipe 15, the inside of the fixed core 40, the inside of the movable core 34, the fuel passage 251 defined in the needle 25, and the opening 252 defined in the needle 25. The fuel flowing into the fuel passage 27 further flows into the nozzle hole 24, which is formed in the nozzle plate 23, after passing through the gap between the valve body 21 and the needle 25, which lifts from the valve seat 22, so that fuel is injected out of the nozzle hole 24.

When supplying electricity to the coil 31 is terminated, the magnetic attractive force between the fixed core 40 and the movable core 34 substantially disappears, so that the movable core 34 integrated with the needle 25 moves to the opposite side of the fixed core 40 by the biasing force i.e., resiliency of the spring 14. In this condition, the movable core 34 is quickly removed from the notch 41, in which the squeeze force is restricted from arising in the fixed core 40, as the initial point of the spacing motion therebetween. Therefore, the seal portion 26 seats onto the valve seat 22 once more, so that the fuel flow between the fuel passage 27 and the nozzle hole 24 is blocked. Thus, injection of fuel is terminated.

In this embodiment, the fixed core 40 has the notch 41 in the end thereof on the side of the movable core 34. Therefore, when the movable core 34 is spaced from the fixed core 40, the squeeze force is not apt to arise around the notch 41, so that the integrated movable core 34 and the needle 25 are capable of readily quickly moving to the side of the valve seat 22 by the biasing force of the spring 14 when the electricity supply to the coil 31 is terminated. In consequence, the response of both the movable core 34 and the needle 25 can be enhanced responding to the termination of the electricity supply to the coil 31. Therefore, injection of fuel from the nozzle hole 24 can be accurately controlled in a short period, so that the amount of fuel injected from the nozzle hole 24 can be accurately controlled.

In this embodiment, the contact surfaces between the fixed core 40 and the movable core 34 can be restricted from varying, even when the injector 10 repeats operation. The force needed for the spacing motion of the movable core 34 from the fixed core 40 is associated with variation in this contact surface as time elapses. In this structure, the force needed for the spacing motion of the movable core 34 from the fixed core 40 can be restricted from varying even time elapses. Therefore, the response of the movable core 34 and the needle 25 can be restricted from varying even time elapses, so that variation in the amount of fuel injected from the nozzle hole 24 can be reduced.

Furthermore, in this embodiment, the contact surfaces between the fixed core 40 and the movable core 34 can be restricted from increasing caused by fitting to each other. The end surface of the fixed core 40 on the side of the movable core 34 may slightly deform, however, the amount of deformation of the end of the fixed core 40 may be approximately 0.5 μm to 1.0 μm, so that the deformation may not cause a problem in use of the injector 10. Therefore, the end of the fixed core 40 on the side of the movable core 34 need not be hardened by forming a hardened layer such as chrome plated layer. Therefore, the fixed core 40 can be readily manufactured, so the manufacturing process of the fixed core 40 can be simplified. In addition, the chrome plating process, which is generally expensive, becomes unnecessary, so that the manufacturing cost of the fixed core 40 can be reduced.

Furthermore, in this embodiment, the notch 41 is formed to be in a substantially tapered shape. Therefore, the notch 41 can be readily manufactured by forming a slope on the end surface of the fixed core 40. Therefore, the fixed core 40 can be easily manufactured.

Second Embodiment

Figure 3A:
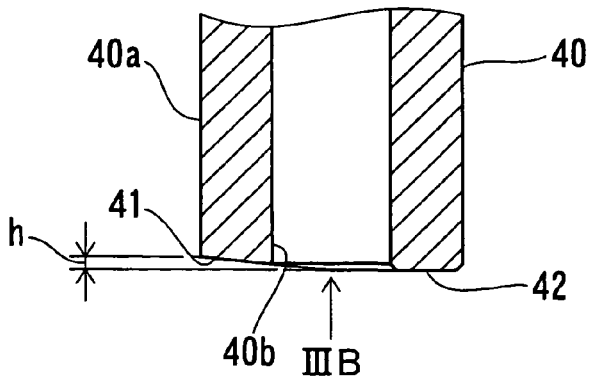
FIG. 3A is a cross sectional side view showing a fixed core of the injector.
Figure 3B:
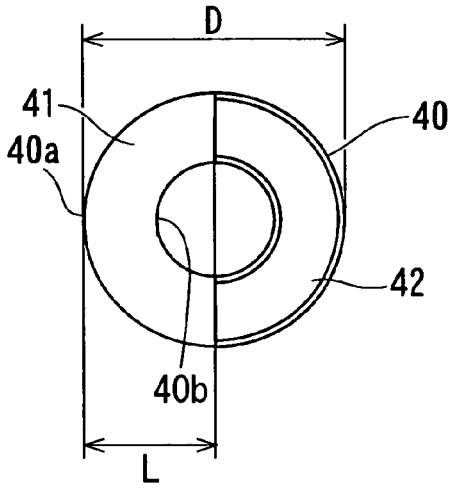
FIG. 3B is a view when being viewed from the arrow IIIB in FIG. 3A, according to the second embodiment of the present invention.

As shown in FIGS. 3A, 3B, the notch 41 of the fixed core 40 extends for a half of the circumferential periphery of the fixed core 40 in the circumferential direction of the fixed core 40. Specifically, the radial length L of the notch 41 is substantially equal to D/2. In this structure, the notch 41 is in a substantially semicircular shape, i.e., substantially C-shape (arch shape). The notch 41 and the land 42 are substantially symmetric with respect to the centerline of the end surface of the fixed core 40. The notch 41 is formed to be in a substantially tapered shape such that the notch 41 protrudes to the side of the movable core 34. The notch 41 protrudes from the outer circumferential periphery 40*a* to the inner circumferential periphery 40*b*.

In this embodiment, the notch 41 has the area, which is substantially half of the total area of the end surface of the fixed core 40. Therefore, the contact area, in which the fixed core 40 makes contact with the movable core 34, becomes substantially half of the contact area in a structure, in which the end face of the fixed core 40 on the side of the movable core 34 does not have the notch 41. Therefore, the squeeze force arising around the notch 41, when the fixed core 40 is spaced from the movable core 34, can be reduced. Thus, when the electricity supply to the coil 31 is terminated, the integrated movable core 34 and the needle 25 are capable of quickly moving to the valve seat 22 by the biasing force of the spring 14. In consequence, the response of both the movable core 34 and the needle 25 can be enhanced responding to the termination of the electricity supply to the coil 31. Therefore, injection of fuel from the nozzle hole 24 can be accurately controlled in a short period, so that the amount of fuel injected from the nozzle hole 24 can be accurately controlled.

Third and Fourth Embodiments

Figure 4A:
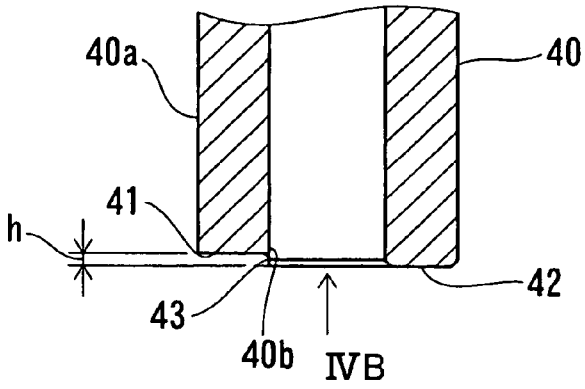
FIG. 4A is a cross sectional side view showing a fixed core of the injector.
Figure 4B:
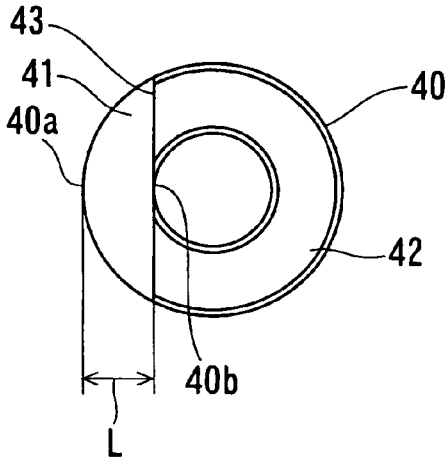
FIG. 4B is a view when being viewed from the arrow IVB in FIG. 4A, according to the third embodiment of the present invention.

As shown in FIGS. 4A, 4B, in the third embodiment, the end of the fixed core 40 on the side of the movable core 34 has the notch 41. This notch 41 is formed in a substantially groove shape, which has the height substantially constant from the outer circumferential periphery 40*a* to the inner circumferential periphery 40*b*. In this structure, the notch 41 and the land 42 form a step 43 therebetween. The notch 41 is formed in a substantially bow shape, similarly to the first embodiment.

Figure 5A:
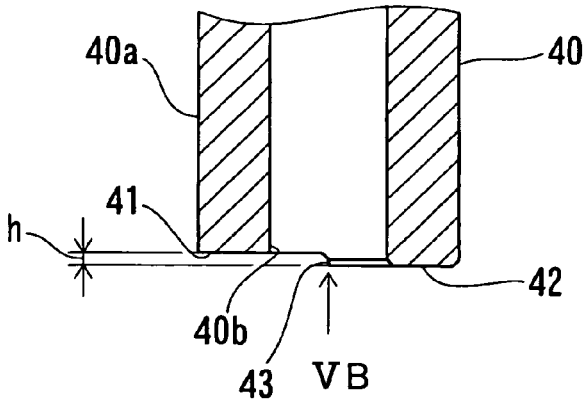
FIG. 5A is a cross sectional side view showing a fixed core of the injector.
Figure 5B:
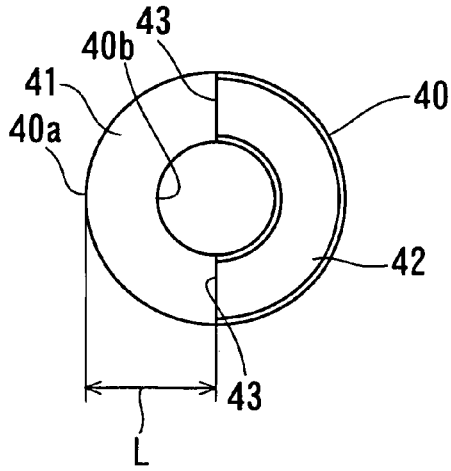
FIG. 5B is a view when being viewed from the arrow VB in FIG. 5A, according to the fourth embodiment of the present invention.

As shown in FIGS. 5A, 5B, in the fourth embodiment, the end of the fixed core 40 on the side of the movable core 34 has the notch 41. This notch 41 is formed in a substantially groove shape, which has the height substantially constant from the outer circumferential periphery 40*a* to the inner circumferential periphery 40*b*. In this structure, the notch 41 and the land 42 form the step 43 therebetween. The notch 41 is formed in a substantially semicircular shape (arch shape), similarly to the second embodiment.

In these third and fourth embodiments, the notch 41 is in the substantially groove shape that forms the step 43 with respect to the land 42. The notch 41 communicates the outer circumferential periphery 40*a* with the inner circumferential periphery 40*b* of the fixed core 40. Therefore, the squeeze force arising around the notch 41, when the fixed core 40 is spaced from the movable core 34, can be reduced. In consequence, the response of the movable core 34 can be enhanced. Therefore, injection of fuel from the nozzle hole 24 can be accurately controlled in a short period, so that the amount of fuel injected from the nozzle hole 24 can be accurately controlled.

Fifth, Sixth, Seventh, and Eighth Embodiments

Figure 6A:
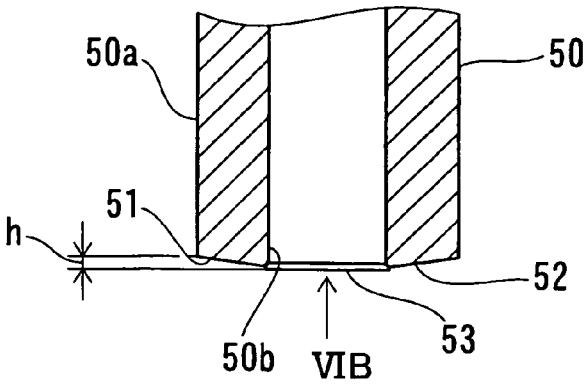
FIG. 6A is a cross sectional side view showing a fixed core of the injector.
Figure 6B:
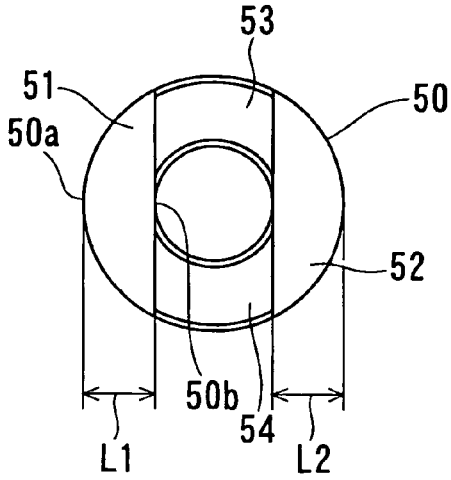
FIG. 6B is a view when being viewed from the arrow VIB in FIG. 6A, according to the fifth embodiment of the present invention.

As shown in FIGS. 6A, 6B, in the fifth embodiment, the end of a fixed core 50 on the side of the movable core 34 has notches 51, 52. The notches 51, 52 are arranged on both sides with respect to the radial direction of the end surface of the fixed core 50. Therefore, the end of the fixed core 50 on the side of the movable core 34 has lands 53, 54, in addition to the notches 51, 52. These lands 53, 54 are interposed between the notches 51, 52. The notches 51, 52 are substantially symmetric with respect to the center line of the end surface of the fixed core 50. The notch 51 has the radial length L1, and the notch 52 has the radial length L2 with respect to the radial direction of the fixed core 50. In this structure, the radial length L1 is substantially equal to the radial length L2. The notches 51, 52 are respectively formed to be in substantially tapered shapes such that the notches 51, 52 respectively protrude to the side of the movable core 34 (FIG. 6A). The notches 51, 52 respectively protrude from an outer circumferential periphery 50*a* to an inner circumferential periphery 50*b*, similarly to the first embodiment.

Figure 7A:
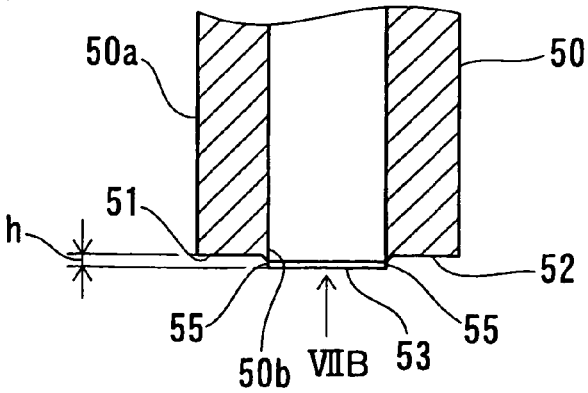
FIG. 7A is a cross sectional side view showing a fixed core of the injector.
Figure 7B:
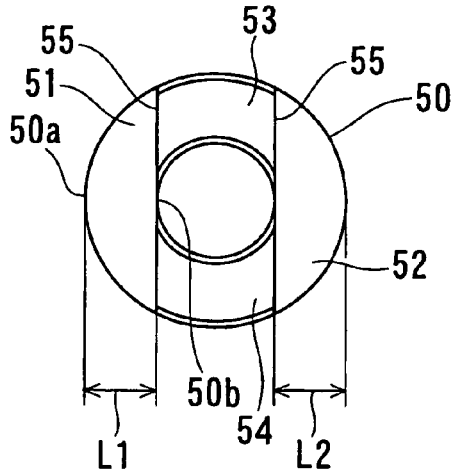
FIG. 7B is a view when being viewed from the arrow VIIB in FIG. 7A, according to the sixth embodiment of the present invention.

As shown in FIGS. 7A, 7B, in the sixth embodiment, the end of the fixed core 50 on the side of the movable core 34 has the notches 51, 52. The notches 51, 52 are arranged on both sides with respect to the radial direction of the end surface of the fixed core 50. Therefore, the end of the fixed core 50 on the side of the movable core 34 has lands 53, 54, in addition to the notches 51, 52. These lands 53, 54 are interposed between the notches 51, 52. The notches 51, 52 are substantially symmetric with respect to each other. The notch 51 has the radial length L1, and the notch 52 has the radial length L2 with respect to the radial direction of the fixed core 50. In this structure, the radial length L1 is substantially equal to the radial length L2. Each of the notches 51, 52 is formed to be in a substantially groove shape, which has the height substantially constant from the outer circumferential periphery 50*a* to the inner circumferential periphery 50*b*, similarly to the third and fourth embodiments. In this structure, the notch 51 and the lands 53, 54 form the steps 55 thereamong. In addition, the notch 52 and the lands 53, 54 form the steps 55 thereamong.

Figure 8A:
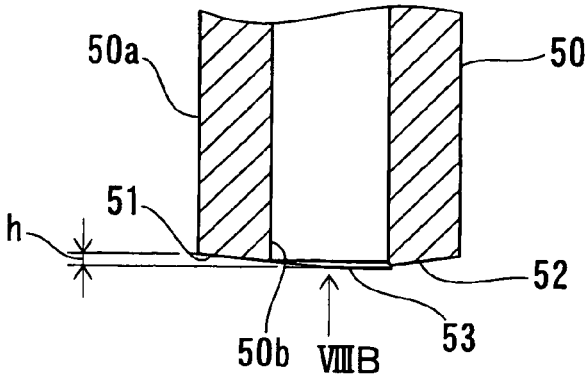
FIG. 8A is a cross sectional side view showing a fixed core of the injector.
Figure 8B:
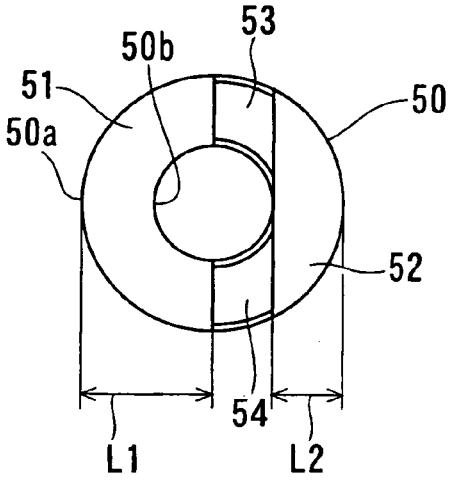
FIG. 8B is a view when being viewed from the arrow VIIIB in FIG. 8A, according to the seventh embodiment of the present invention.
Figure 9A:
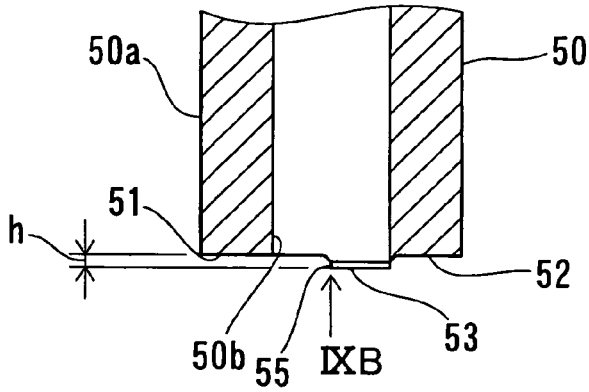
FIG. 9A is a cross sectional side view showing a fixed core of the injector.
Figure 9B:
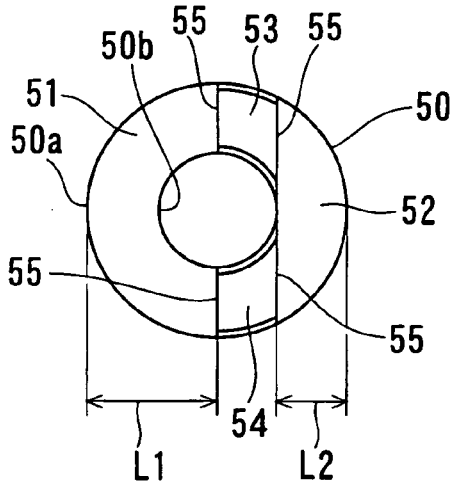
FIG. 9B is a view when being viewed from the arrow IXB in FIG. 9A, according to the eighth embodiment of the present invention.

In the seventh embodiment as shown in FIGS. 8A, 8B, and in the eighth embodiment as shown in FIGS. 9A, 9B, the notch 51 has the radial length L1, and the notch 52 has the radial length L2 with respect to the radial direction of the fixed core 50. In these structures, the dimension of the fixed core 50 satisfies the following relationship: L1+L2≦(3D−d)/4.

Each of the notches 51, 52 has the height h on the side of the outer circumferential periphery 50*a* of the fixed core 50. In this structure, the dimension of the fixed core 50 satisfies the following relationship: 5 μm≦h≦2.0 mm.

As shown in FIGS. 8A, 8B, in the seventh embodiment, the end of the fixed core 50 on the side of the movable core 34 has the notches 51, 52. The notches 51, 52 are arranged on both sides with respect to the radial direction of the end surface of the fixed core 50. Therefore, the end of the fixed core 50 on the side of the movable core 34 has lands 53, 54, in addition to the notches 51, 52. These lands 53, 54 are interposed between the notches 51, 52. The notches 51, 52 are dissymmetric with respect to the center line of the end surface of the fixed core 50.

In the seventh embodiment, the notch 51 is formed in a substantially semicircular shape (arch shape), and the notch 52 is formed in a substantially bow shape. The notch 51 has the radial length L1, and the notch 52 has the radial length L2 with respect to the radial direction of the fixed core 50. In this structure, the radial length L2 is equal to or less than the radial length L1. The notches 51, 52 are respectively formed to be in substantially tapered shapes such that the notches 51, 52 respectively protrude to the side of the movable core 34 (FIG. 8A). The notches 51, 52 respectively protrude from the outer circumferential periphery 50*a* to the inner circumferential periphery 50*b*, similarly to the first embodiment.

As shown in FIGS. 9A, 9B, in the eighth embodiment, the end of the fixed core 50 on the side of the movable core 34 has the notches 51, 52. The notches 51, 52 are arranged on both sides with respect to the radial direction of the end surface of the fixed core 50. Therefore, the end of the fixed core 50 on the side of the movable core 34 has lands 53, 54, in addition to the notches 51, 52. These lands 53, 54 are interposed between the notches 51, 52. The notches 51, 52 are dissymmetric with respect to each other.

In the eighth embodiment, the notch 51 is formed in a substantially semicircular shape (arch shape), and the notch 52 is formed in a substantially bow shape. The notch 51 has the radial length L1, and the notch 52 has the radial length L2 with respect to the radial direction of the fixed core 50. In this structure, the radial length L2 is equal to or less than the radial length L1. Each of the notches 51, 52 is formed to be in a substantially groove shape, which has the height substantially constant from the outer circumferential periphery 50*a* to the inner circumferential periphery 50*b*, similarly to the third and fourth embodiments. In this structure, the notch 51 and the lands 53, 54 form the steps 55 thereamong. In addition, the notch 52 and the lands 53, 54 form the steps 55 thereamong.

In the above fifth, sixth, seventh, and eighth embodiments, both the notches 51, 52 are in one of the substantially tapered shape and the substantially groove shape. However, one of the notches 51, 52 may be in one of the substantially tapered shape and the substantially groove shape, and the other of the notches 51, 52 may be in the other of the substantially tapered shape and the substantially groove shape.

Ninth and Tenth Embodiments

Figure 10A:
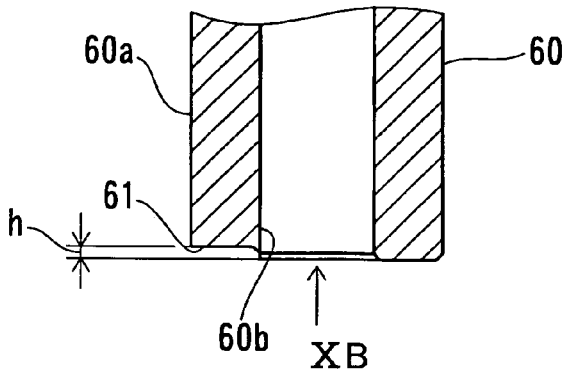
FIG. 10A is a cross sectional side view showing a fixed core of the injector.
Figure 10B:
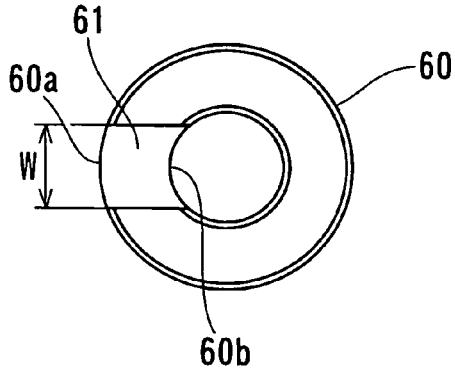
FIG. 10B is a view when being viewed from the arrow XB in FIG. 10A, according to the ninth embodiment of the present invention.

As shown in FIGS. 10A, 10B, in the ninth embodiment, the end of a fixed core 60 has a notch 61 partially with respect to the circumferential direction of the fixed core 60. In the ninth embodiment, the notch 61 is formed to be in a substantially arch shape. The notch 61 is formed to be in a substantially groove shape that communicates an outer circumferential periphery 60*a* with an inner circumferential periphery 60*b* of the fixed core 60. The notch 61 has a width W with respect to the circumferential direction of the fixed core 60. The dimension of the fixed core 60 satisfies the following relationship: d/4≦W≦(3D−d)/4. The height h of the notch 61 satisfies the following relationship: 5 μm≦h≦2.0 mm, similarly to the above embodiments.

Figure 11A:
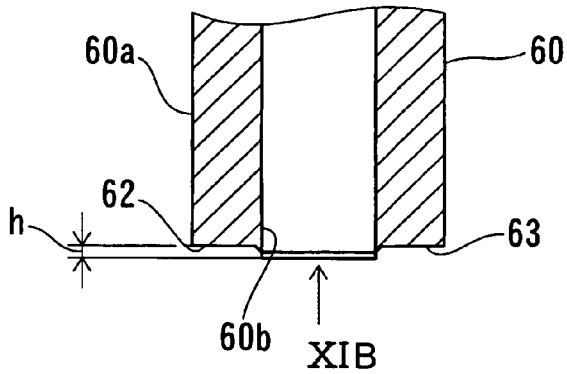
FIG. 11A is a cross sectional side view showing a fixed core of the injector.
Figure 11B:
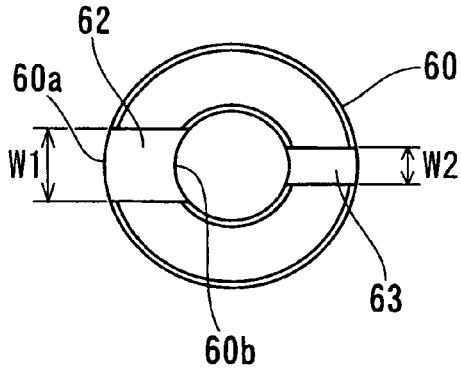
FIG. 11B is a view when being viewed from the arrow XIB in FIG. 11A, according to the tenth embodiment of the present invention.
Figure 12A:
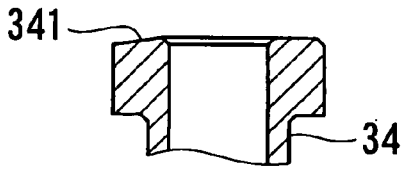
FIGS. 12A, 12B, 12C, 12D, 12E, 12F, 12G, and 12H are cross sectional side views showing movable cores of the injector, according to variations of an embodiment of the present invention.
Figure 12B:
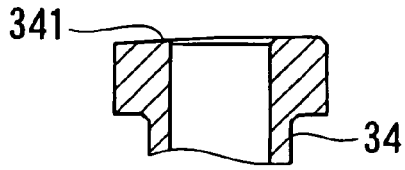
Figure 12C:
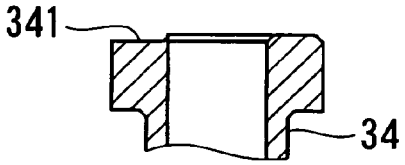
Figure 12D:
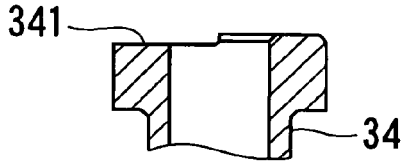
Figure 12E:
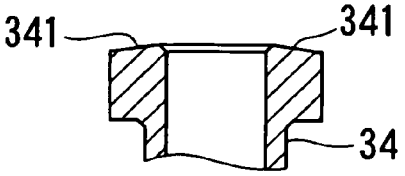
Figure 12F:
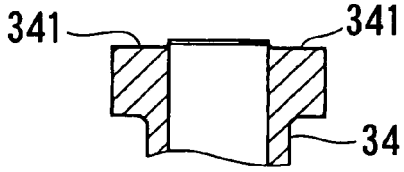
Figure 12G:
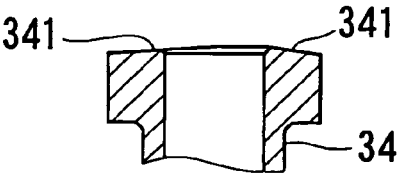
Figure 12H:
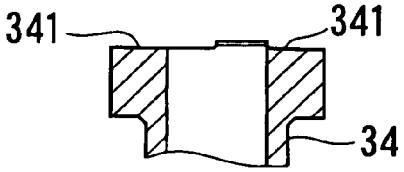

As shown in FIGS. 11A, 11B, in the tenth embodiment, the end of a fixed core 60 has notches 62, 63 partially with respect to the circumferential direction of the fixed core 60. The notches 62, 63 are respectively formed partially in the fixed core 60 with respect to the circumferential direction of the fixed core 60. In this structure, the notches 62, 63 are respectively formed to be in substantially arch shapes. The notches 62, 63 are respectively formed to be in substantially groove shapes that respectively communicate the outer circumferential periphery 60*a* with the inner circumferential periphery 60*b* of the fixed core 60. The width W1 of the notch 62 may be the same as the width W2 of the notch 63. Alternatively, the width W1 of the notch 62 may not be the same as the width W2 of the notch 63.

At least one of the notches 61, 62, and 63 in the ninth and tenth embodiments may be formed to be in a substantially tapered shape, instead of the substantially groove shape.

Variations of Embodiment

In the above embodiments, the fixed core 40, 50, and 60 has at least one of the notches 41, 51, 52, 61, 62, and 63. However, as shown in FIGS. 12A to 12H, the end of the movable core 34 on the side of the corresponding fixed core 40, 50, and 60 may have a notch 341. At least one notch may be formed on both the end of the fixed core 40, 50, and 60 on the side of the movable core 34 and the end of the movable core 34 on the side of the fixed core 40, 50, and 60. When the notch 341 is formed in the movable core 34, the notch formed in the fixed core 40, 50, and 60 may be symmetric or dissymmetric. When the notch 341 is formed in the movable core 34, the notch 341 may be symmetric or dissymmetric.

The nozzle hole may be formed in the valve body 21, instead of forming in the nozzle plate 23. The driving unit 30 is not limited to be applied to the injector 10. The driving unit 30 may be applied to any other fluidic devices such as a pressure control device and a solenoid apparatus.

Eleventh and Twelfth Embodiments

Figure 13A:
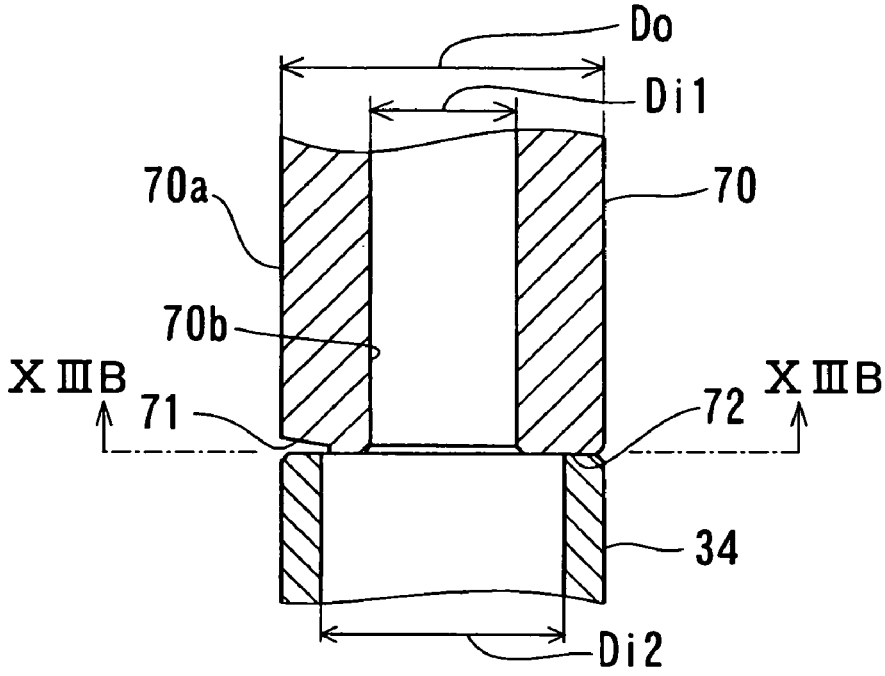
FIG. 13A is a cross sectional side view showing a fixed core and a movable core of the injector.
Figure 13B:
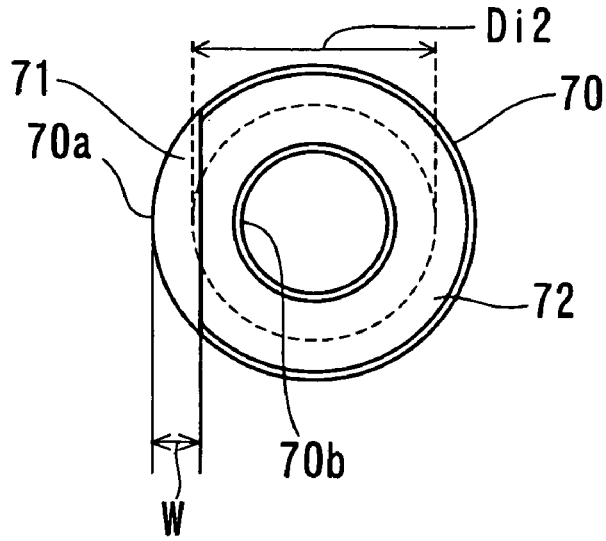
FIG. 13B is a view when being viewed from the arrows XIIIB-XIIIB in FIG. 13A, according to the eleventh embodiment of the present invention.

As shown in FIGS. 13A, 13B, in the eleventh embodiment, the end of a fixed core 70 on the side of the movable core 34 has a notch 71, which is recessed with respect to the axial direction of the fixed core 70. The end of the fixed core 70 on the side of the movable core 34 excluding the notch 71 forms a land 72, which makes contact with the end of the movable core 34 on the side of the fixed core 70. The notch 71 is formed to be in a substantially tapered shape such that the notch 71 protrudes to the side of the movable core 34, similarly to the first embodiment. The notch 71 protrudes from an outer circumferential periphery 70*a* to an inner circumferential periphery 70*b*. In this structure, the distance between the fixed core 70 and the movable core 34 becomes large on the side of the outer circumferential periphery 70*a*. Specifically, the distance between the fixed core 70 and the movable core 34 becomes large from the inner circumferential periphery 70*b* toward the side of the outer circumferential periphery 70*a*.

As shown in FIG. 13B, the notch 71 has the radial length W with respect to the radial direction of the fixed core 70. The fixed core 70 and the movable core 34 respectively have the outer diameter Do. The fixed core 70 has the inner diameter Di1. The movable core 34, which opposes to the fixed core 70, has the inner diameter Di2. The dimensions of the fixed core 70 and the movable core 34 satisfy the following relationship: $(Do-Di2)/2<W\leqq(Do-Di1)/2$. Here, $(Do-Di2)/2$ represents the wall thickness of the end of the movable core 34 on the side of the fixed core 70. Besides, $(Do-Di1)/2$ represents the wall thickness of the end of the fixed core 70 on the side of the movable core 34. In this structure, the radial length W of the notch 71 is greater than the wall thickness of the movable core 34, and is equal to or less than the wall thickness of the fixed core 70.

In this structure, as referred to FIGS. 13A, 13B, the radial length W of the notch 71 is greater than the wall thickness of the movable core 34, so that the outer circumferential periphery 70*a* of the fixed core 70 communicates with the inner circumferential periphery of the movable core 34 through the notch 71. The dotted line shown in FIG. 13B depicts the inner circumferential periphery of the end of the movable core 34 on the side of the fixed core 70. The notch 71 is formed in the end of the fixed core 70 on the side of the movable core 34, so that the notch 71 defines a sufficient space between the fixed core 70 and the movable core 34. Therefore, when the movable core 34 is spaced from the fixed core 70, the squeeze force is restricted form arising around the notch 71, so that the spacing motion of the movable core 34 from the fixed core 70 can be restricted from being disturbed due to the squeeze force. Thus, the movable core 34 can be readily spaced from the fixed core 70 such that the movable core 34 is detached from the notch 71 as the initial point of the spacing motion. In this structure, the wall thickness of the end of the movable core 34 on the side of the fixed core 70 is less than the wall thickness of the end of the fixed core 70 on the side of the movable core 34. Therefore, the fixed core 70 and the movable core 34 form the gap therebetween, even when the notch does not radially extend from the circumferentially outer periphery to the circumferentially inner periphery on the end of the fixed core 70. That is, when the notch, which has the length greater than the wall thickness of the movable core 34, is formed in the end of the fixed core 70, the fixed core 70 and the movable core 34 form the gap therebetween partially with respect to the circumferential direction thereof. Thus, the squeeze force can be reduced between the fixed core 70 and the movable core 34, so that response of the movement of the movable core 34 can be enhanced.

Furthermore, the end of the fixed core 70 on the side of the movable core 34 has the notch 71 and the land 72. Therefore, the magnetic attractive force, which is generated between the fixed core 70 and the movable core 34 when the coil 31 is supplied with electricity, becomes unbalance between the side of the notch 71 and the side of the land 72. Specifically, this magnetic force becomes large on the side of the land 72, which is in the vicinity of the movable core 34, and becomes small on the side of the notch 71, which is distant from the movable core 34. Therefore, the movable core 34 is attracted to the side of the land 72 of the fixed core 70 by the magnetic attractive force greater than the magnetic attractive force on the side of the notch 71. Thus, the movable core 34 is attracted toward the fixed core 70 on the side of the land 72, so that the movable core 34 is capable of colliding against the fixed core 70 regularly in a constant position. The contact area between the fixed core 70 and the movable core 34 can be restricted from varying, even when the movable core 34 repeatedly collides against the fixed core 70, as the injector 10 is operated.

Figure 14A:
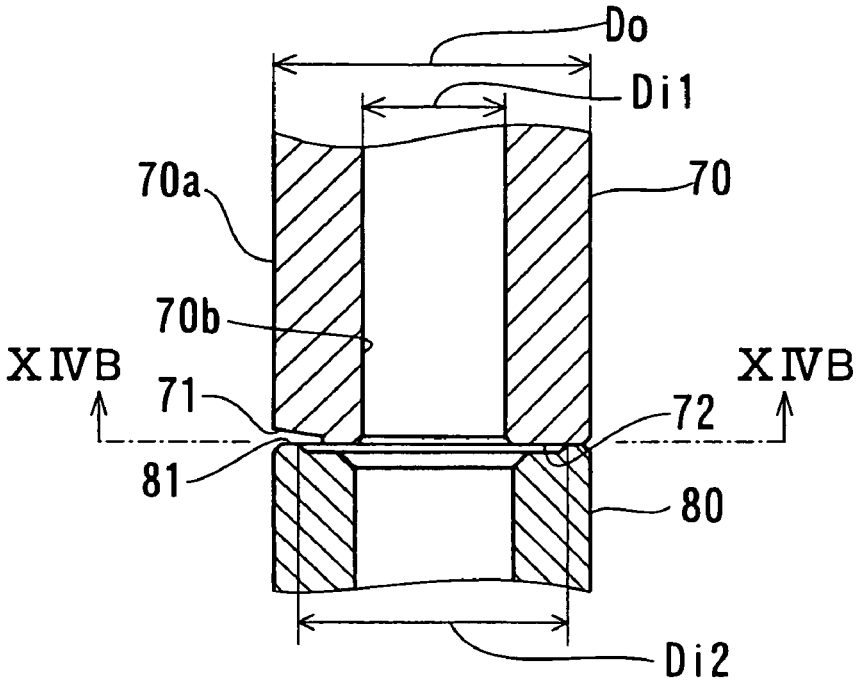
FIG. 14A is a cross sectional side view showing a fixed core and a movable core of the injector.
Figure 14B:
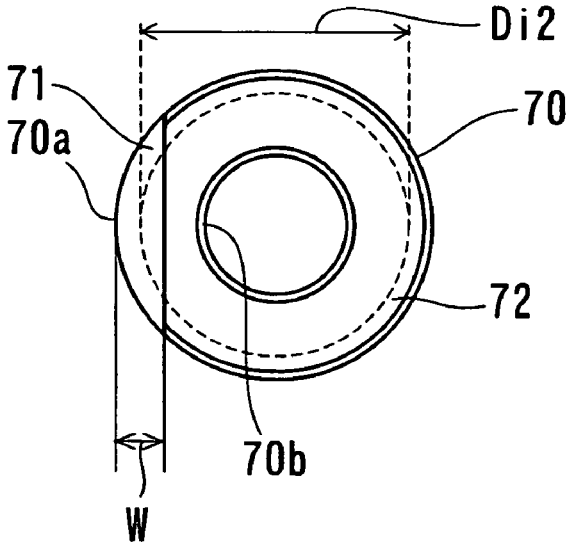
FIG. 14B is a view when being viewed from the arrows XIVB-XIVB in FIG. 14A, according to the twelfth embodiment of the present invention.

As shown in FIGS. 14A, 14B, in the twelfth embodiment, the end of a movable core 80 on the side of the fixed core 70 has a protrusion 81, which protrudes to the side of the fixed core 70. The protrusion 81 continuously extends substantially in the circumferential direction of the movable core 80, so that the protrusion 81 is in a substantially annular shape. In this structure, the substantially annular end of the protrusion 81 of the movable core 80 collides against the fixed core 70. The inner diameter of the movable core 80 varies with respect to the axial direction of the movable core 80. In this structure, the inner diameter of the endmost of the movable core 80 on the side of the fixed core 70 is used for defining the length W of the notch 71. That is, the inner diameter of the contact surface of the movable core 80 with respect to the fixed core 70 is used for defining the length W of the notch 71. Specifically, in this embodiment, the dimensions of the fixed core 70 and the movable core 80 also satisfy the following relationship: $(Do-Di2)/2<W\leqq(Do-Di1)/2$. However, in this relationship, the inner diameter of the annular protrusion 81 of the movable core 80 is substituted for the inner diameter Di2 of the movable core 80.

The length W of the notch 71 is set greater than the thickness of the protrusion 81 of the movable core 80, so that the outer circumferential periphery 70*a* of the fixed core 70 communicates with the inner circumferential periphery of the movable core 80 through the notch 71.

The dotted line shown in FIG. 14B depicts the inner circumferential periphery of the protrusion 81 of the end of the movable core 80 on the side of the fixed core 70. The notch 71 is formed in the end of the fixed core 70 on the side of the movable core 80, so that the notch 71 defines a sufficient space between the fixed core 70 and the movable core 80. Therefore, when the movable core 80 is spaced form the fixed core 70, the squeeze force is restricted form arising around the notch 71, so that the spacing motion of the movable core 80 from the fixed core 70 can be restricted from being disturbed due to the squeeze force. Thus, the movable core 80 can be readily spaced from the fixed core 70 such that the movable core 80 is detached from the notch 71 as the initial point of the spacing motion.

In the above eleventh and twelfth embodiments, the notch 71 is formed in the fixed core 70. However, the arrangement of the notch 71 is not limited to the above embodiments. The notch 71 may be formed in the movable core 34, 80. In addition, the notch may be formed in both the fixed core 70 and the movable core 34, 80. In this case, the shape of the notch 71 formed in the fixed core 70 and the shape of the notch formed in the movable core 34, 80 may be either symmetric or dissymmetric.

The above structures of the embodiments can be combined as appropriate.

In the above embodiments, the solenoid apparatus is used for the fuel injection valve. However, the structure of the solenoid apparatus is not limited to the application to a fuel injection valve. This structure can be used for any other structures, in which at least two members, which are in a contact condition, are spaced from each other.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A solenoid apparatus comprising:

a fixed core;

a coil that generates magnetic attractive force when the coil is supplied with electricity; and a movable core that is attracted to the fixed core by the magnetic attractive force generated between the fixed core and the movable core when the coil is supplied with electricity;

wherein the fixed core has a fixed axial end on a side of the movable core with respect to an axial direction of the fixed core, the movable core has a movable axial end on a side of the fixed core with respect to an axial direction of the movable core, at least one of the fixed axial end and the movable axial end has at least one recession partially in a circumferential direction, the at least one of the fixed axial end and the movable axial end, which has the at least one recession, has an outer circumferential periphery and an inner circumferential periphery, and the outer circumferential periphery communicates with the inner circumferential periphery through the at least one recession with respect to a radial direction of the at least one of the fixed axial end and the movable axial end, a remainder of the at least one of the fixed axial end and the movable axial end, other than the at least one recession, is a land, which does not have a recession, and the at least one recession is dissymmetric.

2. The solenoid apparatus according to claim 1, wherein the at least one recession is in a substantially bow shape.

3. The solenoid apparatus according to claim 2, wherein the at least one of the fixed axial end and the movable axial end, which has the at least one recession, has an outer diameter D and an inner diameter d, the at least one recession has a radial length L with respect to a radial direction of the at least one of the fixed axial end and the movable axial end, which has the at least one recession, and the outer diameter D, the inner diameter d, and the radial length L satisfy a following relationship: $(D-d)/2 \leqq L \leqq (3D-d)/4$.

4. The solenoid apparatus according to claim 1, wherein the at least one recession is in a substantially arch shape.

5. The solenoid apparatus according to claim 4, wherein the at least one of the fixed axial end and the movable axial end, which has the at least one recession, has an outer diameter D and an inner diameter d, the at least one recession has a radial length L with respect to a radial direction of the at least one of the fixed axial end and the movable axial end, which has the at least one recession, and the outer diameter D, the inner diameter d, and the radial length L satisfy a following relationship: $(D-d)/2 \leqq L \leqq (3D-d)/4$.

6. The solenoid apparatus according to claim 4, wherein the at least one of the fixed axial end and the movable axial end, which has the at least one recession, has an outer diameter D and an inner diameter d, the at least one recession has a width W with respect to a circumferential direction of the at least one of the fixed axial end and the movable axial end, which has the at least one recession, and the outer diameter D, the inner diameter d, and the width W satisfy a following relationship: $d/4 \leqq W \leqq (3D-d)/4$.

7. The solenoid apparatus according to claim 1, wherein the at least one recession includes a plurality of recessions, and two of the plurality of recessions are arranged in both ends of the at least one of the fixed axial end and the movable axial end, which has the plurality of recessions, with respect to a radial direction of the at least one of the fixed axial end and the movable axial end.

8. The solenoid apparatus according to claim 1, wherein the fixed axial end of the fixed core has the at least one recession, and the movable axial end of the movable core has the at least one recession.

9. A fuel injection valve comprising:

the solenoid apparatus according to claim 1;

a valve member that integrally connects with the movable core, the valve member being movable together with the movable core in a substantially axial direction of the movable core; and a valve body that has a nozzle hole, which opens and closes when the valve member moves.

10. The solenoid apparatus according to claim 1, wherein the outer circumferential periphery communicates with the inner circumferential periphery through the at least one recession when the fixed core makes contact with the movable core.

11. The solenoid apparatus according to claim 1, wherein the fixed axial end of the fixed core substantially axially opposes to the movable axial end of the movable core.

12. The solenoid apparatus according to claim 1, wherein the at least one of the fixed axial end and the movable axial end, which has the at least one recession, is in a substantially cylindrical shape.

13. The solenoid apparatus according to claim 1, wherein the at least one recession has a height h in an axial direction of the at least one of the fixed axial end and the movable axial end, which has the at least one recession, and the height h of the at least one recession satisfies a following relationship: $5\ \mu m \leqq h \leqq 2.0$ mm.

14. The solenoid apparatus according to claim 1, wherein the at least one recession is dissymmetric with respect to a center line of the at least one of the fixed axial end and the movable axial end.

15. A solenoid apparatus comprising:

a fixed core;

a coil that generates magnetic attractive force when the coil is supplied with electricity; and a movable core that is attracted to the fixed core by the magnetic attractive force generated between the fixed core and the movable core when the coil is supplied with electricity;

wherein the fixed core has a fixed axial end on a side of the movable core with respect to an axial direction of the fixed core, the movable core has a movable axial end on a side of the fixed core with respect to an axial direction of the movable core, at least one of the fixed axial end and the movable axial end has a plurality of recessions, the at least one of the fixed axial end and the movable axial end has an outer circumferential periphery and an inner circumferential periphery which radially communicate with each other, and the plurality of recessions are dissymmetric.

16. The solenoid apparatus according to claim 15, wherein the plurality of recessions are dissymmetric with respect to a center line of the at least one of the fixed axial end and the movable axial end.

* * * * *